United States Patent [19]

Tieben

[11] 4,231,190

[45] Nov. 4, 1980

[54] REMOTELY CONTROLLED GATE OPENER

[75] Inventor: James Tieben, Dodge City, Kans.

[73] Assignee: My-D-Han-D Manufacturing Co., Dodge City, Kans.

[21] Appl. No.: 948,388

[22] Filed: Oct. 4, 1978

[51] Int. Cl.[2] ..... E05F 15/20

[52] U.S. Cl. ..... 49/25; 49/334; 74/89.2

[58] Field of Search ..... 49/25, 139, 324, 326, 49/334, 113; 74/89.2, 89.21, 89.22; 160/188, 189

[56] References Cited

U.S. PATENT DOCUMENTS

| | | | |
|---|---|---|---|
| 1,326,130 | 12/1919 | Elliott | 49/139 X |
| 2,401,082 | 5/1946 | Konter | 49/25 |
| 2,561,623 | 7/1951 | Hall | 49/334 |
| 2,588,879 | 3/1952 | Richards | 160/189 |
| 2,589,478 | 3/1952 | Curtis . | |
| 2,592,891 | 4/1952 | Hall | 49/139 X |
| 2,676,294 | 4/1954 | Wilcox . | |
| 2,895,728 | 7/1959 | Edelman . | |
| 2,920,151 | 1/1960 | Lawick | 160/188 UX |
| 3,076,935 | 2/1963 | Jones . | |
| 3,119,608 | 1/1964 | Bateman . | |
| 3,147,001 | 9/1964 | Purdy . | |
| 3,403,474 | 10/1968 | Spasoff . | |
| 3,445,848 | 5/1969 | Goldstein . | |
| 3,481,387 | 12/1969 | Purdy . | |
| 3,497,995 | 3/1970 | Forsberg . | |
| 3,539,063 | 11/1970 | Masura | 74/89.2 X |
| 3,839,826 | 10/1974 | Ries | 49/25X |
| 4,048,630 | 9/1977 | Deming et al. . | |

*Primary Examiner*—Philip C. Kannan
*Attorney, Agent, or Firm*—Hume, Clement, Brinks, Willian & Olds, Ltd.

[57] ABSTRACT

A remotely controlled gate opener for use with a pivotable fence gate is characterized by a closed loop drive chain which is mounted around a set of three triangularly positioned fixed sprockets including a motorized drive sprocket and two positioning sprockets. The gate opener is mounted adjacent the gate post supporting the gate and the gate is attached to the drive chain at a point between the positioning sprockets such that the drive chain, when propelled by the motor, acts to pivot the gate. The preferred embodiment includes a radio controlled motor controller for remote control of the gate opener.

14 Claims, 4 Drawing Figures

REMOTELY CONTROLLED GATE OPENER

BACKGROUND OF THE INVENTION

The present invention relates to a remotely controlled gate opener suitable for use with pivoting gates and doors. This gate opener is preferably battery powered and can be used in remote locations where alternating current is not readily available.

As farming and cattle raising operations have become more mechanized, a need has arisen for a remotely controlled gate opener for use with fence gates. Cars and trucks are often used now where horses served in the past, and gates which could be readily operated in the past are now an inconvenience. For example, a driver who wants to bring his truck into a fenced area provided with a conventional gate must leave his truck twice: once to open the gate and a second time to close the gate after the truck has been driven through. Thus, a need exists for a simple, reliable, and sturdy gate opener which can be used with conventional gates and remotely operated from a car or truck.

Remotely controlled garage door openers have been in common use for some time. Such door openers generally make use of an overhead structure which serves to support the door opener and the linkage which interconnects the opener and the door. Such door openers are poorly suited for use with pivoting fence gates, which are commonly constructed without any associated overhead structure suitable for mounting the opener.

Attempts have been made to provide gate openers suitable for use with outdoor gates. U.S. Pat. No. 3,839,826 to Ries is one example. However, the Ries gate opener requires the use of a particular type of gate, one which pivots about a horizontal rather than a vertical axis. Thus, the Ries gate opener is not well suited for use with conventional gates of the type which pivot about a vertical gatepost.

SUMMARY OF THE INVENTION

The present invention is directed to an improved remotely controlled gate opener which can be easily and inexpensively installed on a conventional fence gate or similar gate. The gate opener is small, self contained, and easily mounted on a gate post or similar structure. It does not require extensive modification of a gate for installation, and it may be powered by a portable rechargeable battery such as an automotive battery.

The gate opener of this invention includes a closed loop drive linkage which is propelled by a motor mounted near the gatepost adjacent the hinge of a pivotable gate. The drive linkage can be attached to the gate such that the gate is pivoted about its hinge by the drive linkage. The motor is controlled by a remotely actuated motor controller, and a tensioning member is provided in contact with the drive linkage to tension the drive linkage. In the preferred embodiment the tensioning member acts to hold the gate firmly in the closed position after the motor has stopped in order to reduce rattling of the gate against the gatepost, and the controller is radio controlled.

One important advantage of this gate opener is that it can be easily mounted on a conventional fence gate with very little modification of the gate or the gatepost. This gate opener is relatively small and easily transported and installed. Furthermore, its design is simple, rugged, and relatively inexpensive to manufacture. It can be installed on existing gates or used in new installations.

These and other objects and advantages of the present invention will be best understood by reference to the following detailed description taken in conjunction with the appended drawings.

DETAILED DESCRIPTION OF A PREFERRED EMBODIMENT

Figure 1:
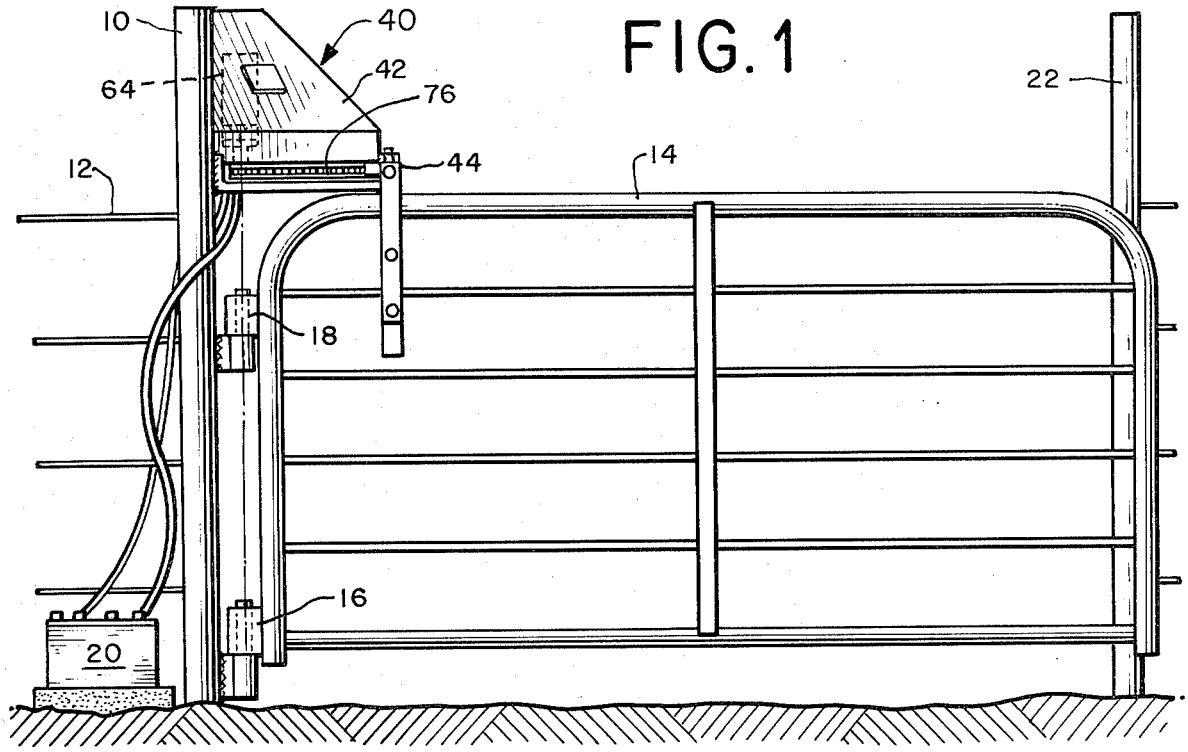
FIG. 1 is an elevation view of a preferred embodiment of the gate opener of this invention installed on a pivotable gate.

Referring now to the drawings, FIG. 1 shows a preferred embodiment 40 of the gate opener of this invention mounted on a gatepost 10. A fence panel 12 is secured to the gate post 10 on one side, and a gate 14 is pivotably connected to the gate post 10 on the other side via hinges 16,18. The gate 14 is attached via an attachment member 44 to the gate opener 40, which is protected from the weather by a rain cover 42. A 12-volt battery 20 provides power to operate the gate opener.

Figure 2:
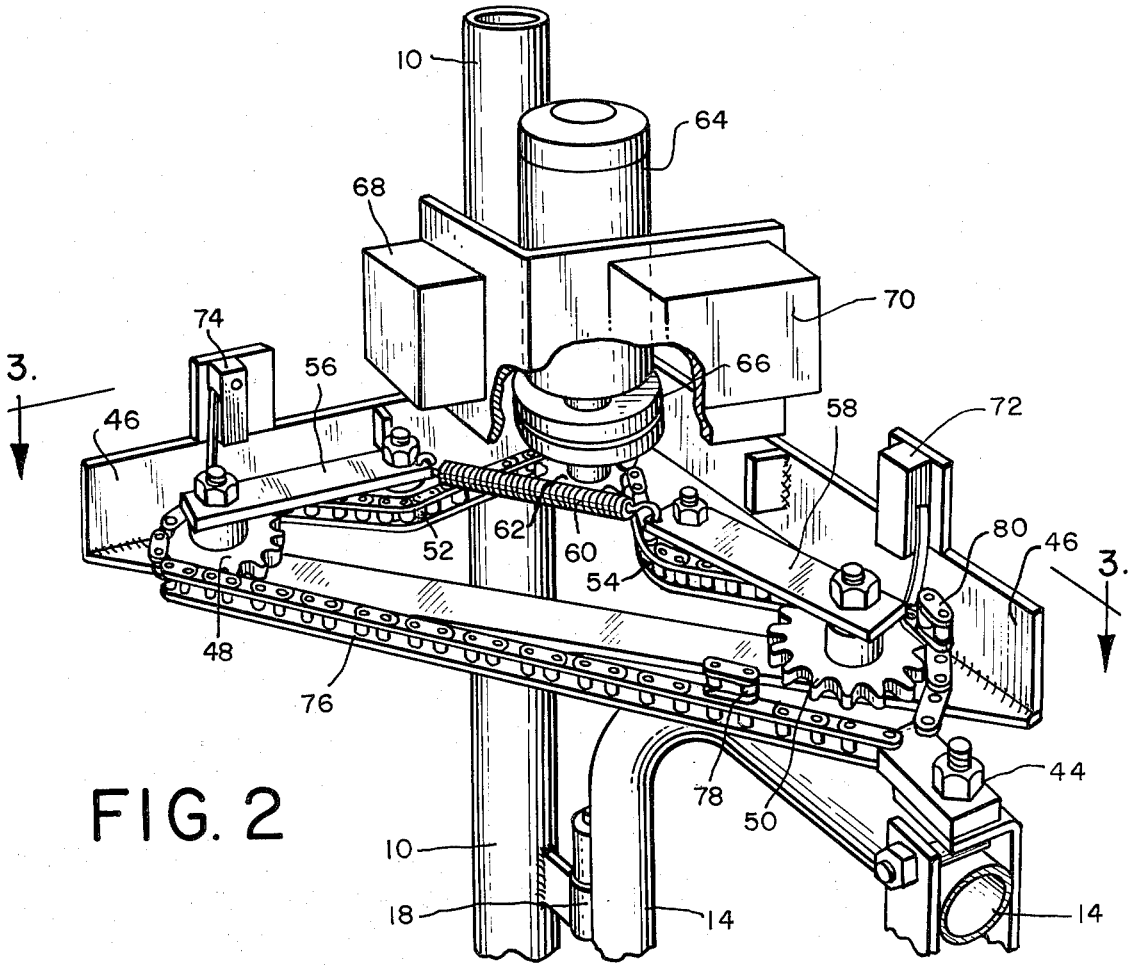
FIG. 2 is a perspective view of the gate opener of FIG. 1 showing the rain cover removed.

FIG. 2 shows the gate opener 40 with the rain cover 42 removed to better show the internal components. The entire gate opener 40 is built on a triangular frame 46 which is mounted to the gate post 10. Positioning sprockets 48,50 are rotatably mounted at two corners of the frame 46. Tensioning sprockets 52,54 are rotatably mounted on idler arms 56,58, which are in turn pivotably mounted on the frame 46 at the positioning sprockets 48,50, respectively. A coil spring 60 is stretched between the idler arms 56,58, as shown, to urge the tensioning sprockets 52,54 together. A reversible 12-volt electric motor 64 having a drive sprocket 62 is included in the gate opener and a slip clutch 66 is preferably provided on the drive sprocket 62 to allow for any obstruction of the gate during operation. The gate opener 40 also includes a radio controlled relay 68 and a reversing contactor 70. The operation of these components will be explained below in connection with FIG. 4.

Figure 3:
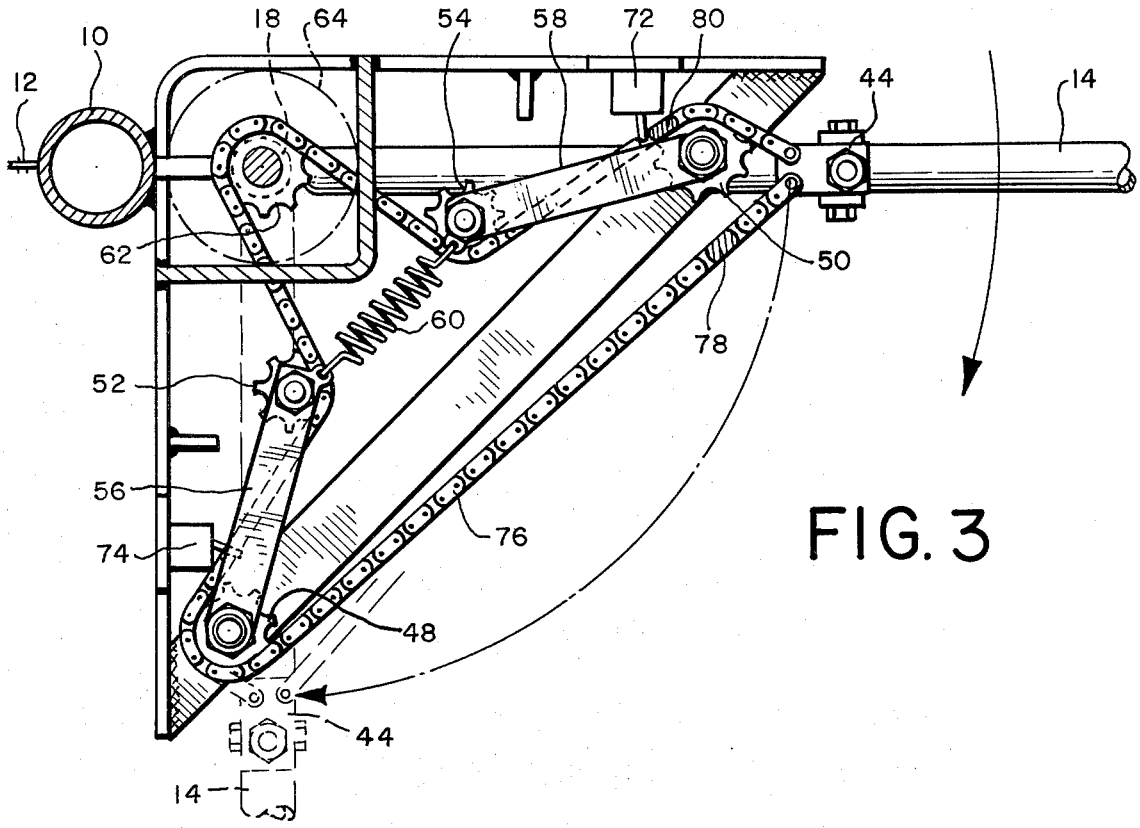
FIG. 3 is a sectional view taken along line 3—3 of FIG. 2 of the drive linkage of the gate opener of FIG. 1 showing the associated drive sprocket, positioning sprockets, and tensioning sprockets.

A closed loop drive linkage such as a drive chain 76 is positioned around the sprockets as shown in FIG. 3. The spring 60 biases the tensioning sprockets 52,54 to maintain the chain 76 under tension. The attachment member 44 is secured to the drive chain 76 between the two positioning sprockets 48,50. Since the attachment member 44 moves in an arc with the pivoting gate 14, the chain 76 deviates from a straight line in the region between the two positioning sprockets 48,50 as the gate pivots. This deviation is a function of gate position, and the tensioning sprockets 52,54 ensure proper tension for all gate positions. Referring back to FIG. 2, two normally closed limit switches 74,72 are mounted on the frame 46, one on either side between one of the positioning sprockets 48,50 and the associated tensioning sprocket 52,54, respectively. Raised links 80,78 are provided on the drive chain to trip the limit switches 72,74 when the gate 14 is in the fully closed and the fully open position, respectively. The limit switches 74,72 act to stop the motor 64 when the gate is either fully open or fully closed. By placing the raised link 80 so that the motor 64 is allowed to operate until the gate 14 has fully closed, the tension provided by the tensioning sprocket 54 on the chain 76 can be used to hold the gate firmly closed and to prevent the gate from rattling against its stop on the opposite gatepost 22.

Figure 4:
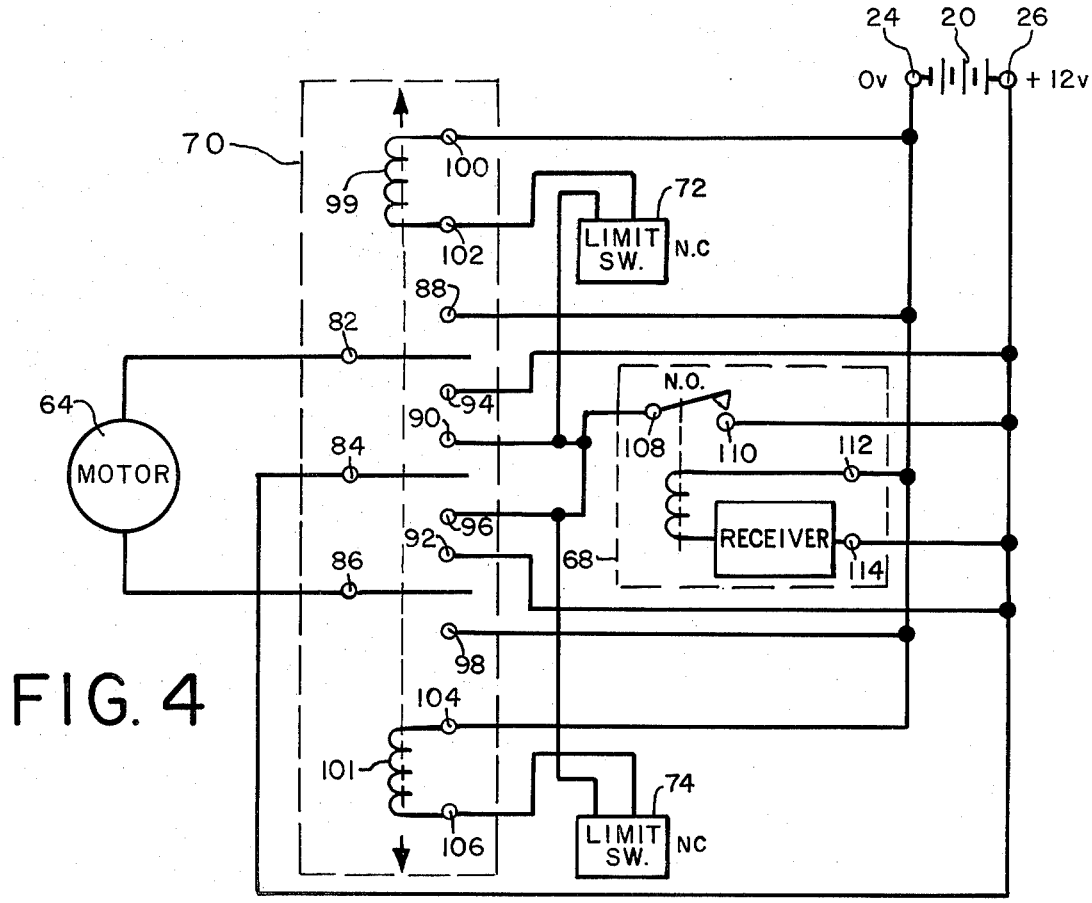
FIG. 4 is an electrical schematic showing the electrical circuits of the gate opener of FIG. 1.

Referring now to FIG. 4, the major features of the electrical circuit of the gate opener are the battery 20, the motor 64, the reversing contactor 70, the radio controlled relay 68 and the normally closed limit switches 72,74. The battery is preferably a 12-volt rechargeable battery such as an automotive battery having a positive terminal 26 and a negative terminal 24.

The reversing contactor 70 has two coils 99,101 having terminals 100,102 and 104,106, respectively. Three independent sets of normally open terminals 82–106 are provided. When the coil 99 is energized, a first set of three connections is established between terminals 82 and 88, 84 and 90, and 86 and 92. When the coil 101 is energized, a second set of three connections is established between the terminals 82 and 94, 84 and 96, and 86 and 98. The reversing contactor 70 includes locking means for ensuring that only one set of three connections is made at any given time, even if both coils 99,101 are energized. In general, the first coil to be energized determines which set of connections is made, and this set is maintained as long as this first coil remains energized even if the other coil is energized at a later time.

The radio controlled relay 68 has switching contacts 108 and 110 as well as relay power contacts 112,114 which are connected to the negative and positive terminals of the battery 20, respectively. The motor 64 is connected between the terminals 82,86; normally closed limit switch 72 is connected between terminals 102 and 90; normally closed limit switch 74 is connected between terminals 106 and 96; terminals 84,92,110,94 are connected to the positive terminal 26 of the battery; terminals 104,98,88, and 100 are connected to the negative terminal 24 of the battery 20; and terminal 108 is connected to both terminals 90 and 96.

The operation of the gate opener 40 will first be explained assuming the gate 14 is originally closed so that the limit switch 72 is open, the limit switch 74 is closed, and the motor 64 is off. When the radio controlled relay 68 is activated by a remotely generated radio signal the switching contacts 108,110 close, conducting a 12-volt signal from the battery terminal 26 to both limit switches 72,74. Current flows through the closed limit switch 74 through the coil 101, which operates the reversing contactor to establish contact between terminals 82 and 94, 84 and 96, and 86 and 98, thereby applying 12 volts across the motor 64 and the coil 101. Thus, the relay 70 acts as a latching relay, and a momentary closure of the radio relay contacts 108,110 causes the reversing contactor 70 to apply voltage to the motor 64 and to maintain this voltage on the motor indefinitely. The motor operates to open the gate 14 and after some gate movement the limit switch 72 is closed, thereby energizing the coil 99 as well as the coil 101. However, as previously explained, the reversing contactor 70 operates to maintain the originally established connections and the motor 64 continues to operate until the gate reaches the open position, whereupon the limit switch 74 opens, voltage is removed from the coil 101, and the motor 64 is stopped.

The reverse cycle used in closing the gate 14 is very similar, except that the limit switch 72 is closed at the start of the cycle, and, therefore, current is originally passed to coil 99 instead of coil 101. This causes the reversing contactor 70 to apply reverse voltage to the motor 64, thereby causing the motor 64 to operate in the reverse direction to close the gate. Once again, the motor operates until the appropriate limit switch is opened.

The above described gate opener has been built and found to operate successfully under actual operating conditions. As constructed the following major components were used: the motor 64 was a 12-volt reversible D.C. power winch motor manufactured by Superwinch, Inc., Putnam, Conn.; the radio controlled relay was a 12-volt receiver manufactured by Linear Corp. Inglewood, Calif. (Model No. 67FSK); the radio transmitter was also manufactured by Linear Corp. (Model D-22) and the reversing contactor was manufactured by Struthers-Dunn, Inc., Pitman, N.J. (Type A275KXX).

Of course, it should be understood that various changes and modifications to the preferred embodiment described above will be apparent to those skilled in the art. Such changes and modifications can be made without departing from the scope of the invention and without diminishing its attendant advantages. It is, therefore, intended that such changes and modifications be covered by the following claims.

I claim:

1. A remotely controlled gate opener for use with a gate pivotably mounted to a gate support structure, said gate opener comprising:

a frame mounted adjacent the gate support structure;

a motor mounted on the frame;

a drive member rotatably driven by the motor;

a positioning member mounted on the frame;

a closed loop drive linkage mounted around the drive member and the positioning member, said drive linkage drivingly engaged with the drive member such that the motor operates to propel the drive linkage;

means for maintaining the drive linkage in tension;

means for attaching the drive linkage to the gate at a point spaced from the pivot axis of the gate such that the gate causes the attaching means to move along a curved line as the gate pivots, thereby causing the contour of the drive linkage to change as the gate pivots; and remotely controlled switching means for selectively activating the motor to open and close the gate.

2. The gate opener of claim 1 further including a frame mounted limit switch which cooperates with the drive linkage to deactivate the motor when the drive linkage reaches a predetermined position.

3. The gate opener of claim 1 wherein the drive member includes a sprocket and the drive linkage includes a closed loop drive chain.

4. The apparatus of claim 1 wherein the switching means is radio controlled.

5. The gate opener of claim 1 wherein the tensioning means contacts the drive linkage between the drive member and the attachment means such that the attachment means approaches the tensioning means as the gate is pivoted to the closed position and the tensioning means exerts a force on the drive linkage which biases the gate in the closed position after the motor has been deactivated.

6. The gate opener of claim 1 further including clutch means mounted between the motor and the drive member for permitting relative movement between the motor and the drive member when the torque required to rotate the drive member exceeds a predetermined value.

7. A remotely controlled gate opener for use with a gate pivotably mounted on a gate support member, said gate opener comprising:

frame means for mounting the gate opener adjacent the gate support member;

means for attaching the gate opener to a gate at a point on the gate spaced from the pivot axis of the gate;

a electric motor mounted on the frame means;

a drive sprocket mounted on the motor;

first and second positioning sprockets rotatably mounted on the frame means;

a closed loop drive chain secured to the attaching means and mounted on the drive sprocket and the positioning sprockets such that the attaching means is positioned between the pair of positioning sprockets;

first and second tensioning sprockets biased against the drive chain to provide tensioning force, said first and second tensioning sprockets contacting the drive chain between the drive sprocket and said first and second positioning sprockets, respectively; and remotely controlled switching means connected to the motor for selectively activating the motor, said motor operating to rotate the drive sprocket and to propel the drive chain and the attaching means to pivot the gate, said first and second tensioning sprockets operating to bias the gate in the closed position after the gate has been pivoted to the closed position and the motor has been deactivated.

8. A remotely controlled gate opener for use with a gate pivotably mounted to a gate support structure, said gate opener comprising:

a frame mounted adjacent the gate support structure;

a reversible motor mounted on the frame;

a drive member rotatably driven by the motor;

a first positioning member mounted on the frame;

a closed loop, flexible drive linkage mounted around the drive member and the first positioning member, said drive linkage drivingly engaged with the drive member such that the motor operates to propel the drive linkage, said drive linkage disposed in a plane substantially perpendicular to the pivot axis of the gate;

tensioning means for maintaining the drive linkage in tension;

an attaching member secured both to the gate, at a point spaced from the pivot axis of the gate, and to the drive linkage such that the attaching member and the drive linkage secured to the attaching member are moved in an arc as the gate pivots, thereby causing the contour of the drive linkage to change as the gate pivots; and remotely controlled switching means for selectively activating the motor to open and close the gate.

9. The gate opener of claim 8 wherein the drive member and the first positioning member include sprockets and the drive linkage includes a drive chain.

10. The gate opener of claim 8 further including a second positioning member mounted on the frame such that the drive member and the first and second positioning members define the three points of a triangle, said attaching member secured to the drive linkage at a point between the first and second positioning members.

11. The gate opener of claim 10 wherein the tensioning means includes a first spring biased tensioning member disposed to contact the drive linkage between the drive member and the first positioning member, and a second spring biased tensioning member disposed to contact the drive linkage between the drive member and the second positioning member.

12. The gate opener of claim 10 wherein the drive member and the first and second positioning members include sprockets and the drive linkage includes a drive chain.

13. The gate opener of claim 11 wherein the drive member, the first and second positioning members, and the first and second tensioning members include sprockets and the drive linkage includes a drive chain.

14. The gate opener of claim 11 wherein the first and second tensioning members are spring biased together by a spring coupled therebetween.

* * * * *